United States Patent [19]

Moore

[11] Patent Number: 4,552,391

[45] Date of Patent: Nov. 12, 1985

[54] PORTABLE ENCLOSURE WITH COMBINED LATCH AND SUPPORT SYSTEM

[75] Inventor: Larry V. Moore, Richardson, Tex.

[73] Assignee: Rockwell International Corporation, El Segundo, Calif.

[21] Appl. No.: 338,761

[22] Filed: Jan. 11, 1982

[51] Int. Cl.[4] ..... E05C 5/00

[52] U.S. Cl. ..... 292/5; 248/496; 73/431

[58] Field of Search ..... 292/5, 68, 152, 57, 292/288, 259; 248/496, 489; 73/431

[56] References Cited

U.S. PATENT DOCUMENTS

| | | | |
|---|---|---|---|
| 490,567 | 1/1893 | Knox | 292/57 |
| 1,049,671 | 1/1913 | Chevola, Jr. | 292/152 |
| 2,116,001 | 5/1938 | Schlage | 292/57 X |
| 3,933,381 | 1/1976 | Schurman | 292/57 |
| 4,193,353 | 3/1980 | Hinton et al. | 292/288 X |

FOREIGN PATENT DOCUMENTS

| | | | |
|---|---|---|---|
| 1933018 | 1/1971 | Fed. Rep. of Germany | 292/152 |

*Primary Examiner*—Richard E. Moore

*Attorney, Agent, or Firm*—Roger N. Chauza; V. Lawrence Sewell; H. Fredrick Hamann

[57] ABSTRACT

A portable enclosure for housing test equipment to test circuitry in a card cage rack employs a combined latch and support system which includes a bracket member retained in the enclosure and movable through an aperture in the enclosure to an extended position for attaching the enclosure to the card cage rack. The bracket member is movable back through the aperture to a retracted position within the enclosure to latch the enclosure closed.

11 Claims, 6 Drawing Figures

PORTABLE ENCLOSURE WITH COMBINED LATCH AND SUPPORT SYSTEM

BACKGROUND OF THE INVENTION

The present invention relates in general to enclosures, and more particularly to a combination latch and support system for use with enclosures.

A multitude of conventional latching mechanisms are known in the art. Moreover, the function provided by each such mechanism is the same, i.e. to keep the enclosure parts together in the closed position. This function is particularly important in enclosures which contain expensive or delicate test equipment. It is highly desirable, therefore, that the latching mechanism chosen is not easily inadvertently opened.

In certain applications where enclosures contain test equipment, there exists a need to support such enclosures, and thus the test equipment, on a card cage rack to conduct tests on circuits located therein.

The prior art generally addresses these needs by providing a latching mechanism for holding the enclosure closed, and separate support apparatus for attaching the enclosure to the card cage rack. Although this approach poses a solution, it is believed that the present invention provides a superior solution to these two needs by combining the latch and support functions into a single apparatus.

In accordance with the present invention, there is featured the provision of a combined latch and support system, where, when retracted within the enclosure, the system performs a latching function, and when extended from the enclosure provides a means for attaching the enclosure to a card cage rack, or the like. Other features and advantages of the invention will become more apparent upon reference to the following specification, claims and appended drawings.

SUMMARY OF THE INVENTION

The combined latch and support system according to the present invention employs a bracket member retained in the enclosure and movable through an aperture in the enclosure to an extended position for attaching the enclosure to a card cage rack or the like. Moreover, the bracket member is movable back through the aperture to a retracted position thereby automatically latching the enclosure closed. In the latched position, the latch and support apparatus is contained entirely within the enclosure thus eliminating any elements protruding from the enclosure. Enclosures employing the concepts of the present invention may thereby be easily stacked together or packaged.

In summary, the present invention provides a simple and cost-effective way of incorporating the latch and support function into one apparatus.

DETAILED DESCRIPTION OF THE PREFERRED EMBODIMENT

Figure 1:
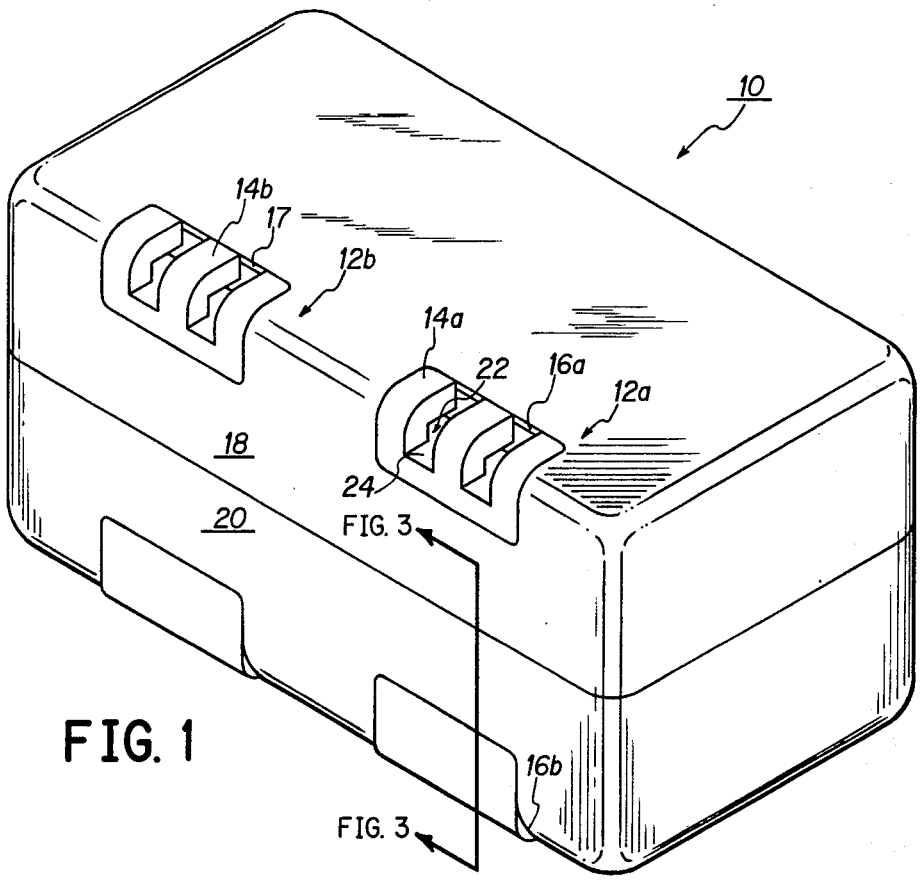
FIG. 1 is an isometric view of a closed enclosure illustrating the latch and support system confined within the enclosure.

FIG. 1 illustrates an enclosure embodying the combined latch and support system of the present invention. The preferred embodiment includes a portable enclosure, generally designated 10, for holding test equipment for testing circuitry in a card cage rack. The invention further includes a pair of latch and support systems, generally designated **12*a* and 12*b*, each of which is broadly comprised of a bracket member 14*a*, 14*b* retained in the enclosure and movable through respective apertures 16*a*, 17** in the enclosure to an extended position for mounting the enclosure to the card cage rack, and movable back through the apertures to a retracted position latching the enclosure closed.

FIG. 1 depicts the enclosure in a closed, latched condition wherein the latch and support apparatus is totally confined within the enclosure so that no protruding parts of the latch and support assembly interfere with the stacking, handling or packaging of the enclosure. This feature is also advantageous insofar as the latch assembly is not easily inadvertently operated to accidentally open the enclosure and, perhaps, spill any loose contents contained therein.

The construction and operation of each latch and support system **12*a*, 12*b* is identical and thus the following detailed discussion of system 12*a*** embraces the other also.

The enclosure of the preferred embodiment has a top portion 18 hinged to a bottom portion 20. The enclosure bottom portion 20 is engaged by the bottom end of the bracket member **14*a* when the latter is in the retracted position, and disengaged and released from such bracket member end when the latter is in the extended position. The top end of bracket member 14*a* protrudes beyond the outer periphera of the enclosure top portion 18** and engagingly hangs on the card cage rack to support the enclosure therefrom.

To be discussed in more detail later, the bracket member **14*a* includes at the extendable end thereof a groove 22 for engagement with the card cage rack, and notches 24** to accommodate engagement of the bracket member at rack locations occupied by printed circuit cards.

For ease of construction the bracket member **14*a*** of the latch and support system is fabricated of nylon.

The bottom aperture **16*b*** serves, in part, as an access opening to the bracket member so that manual force can be applied thereto to release the latch. In this manner one simple movement unlatches the bracket member and deploys the member to the extended position so that the enclosure can be opened and attached to a card cage rack.

Figure 2:
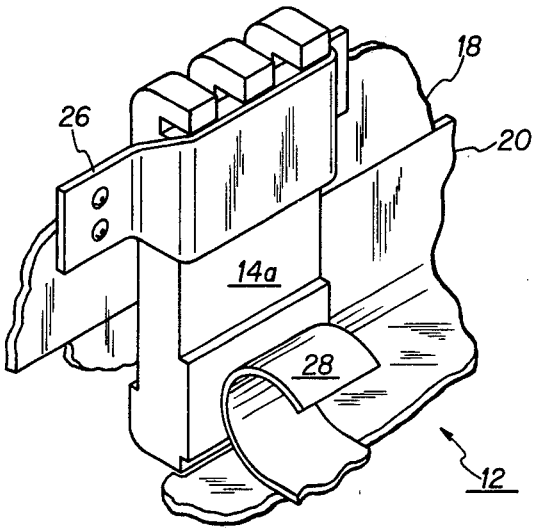
FIG. 2 is an isometric view of the latch and support system as observed from within the enclosure.

Turning now to FIG. 2, there is shown the latch and support system as one would view it from within a closed and latched enclosure. The latch and support system is comprised essentially of the bracket member **14*a* acting to latch the enclosure portions together and to support the enclosure therefrom, a retainer 26 for movably mounting the bracket to the enclosure top 18, and a resilient leaf-type spring 28 for laterally biasing the bracket member 14***a* in a position to maintain the enclosure portions 18 and 20 latched together. In the preferred embodiment, the bracket member 14*a* is held between the enclosure top 18 and the retainer 26 so that it remains attached to that enclosure portion.

Figure 3:
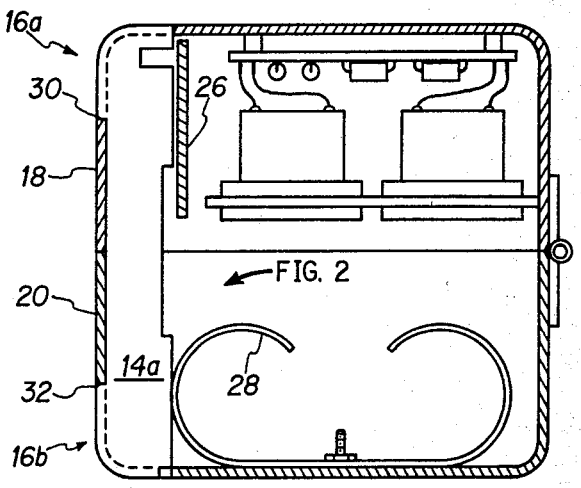
FIG. 3 is a sectional view of the enclosure taken along line 3—3 of FIG. 1, illustrating the bracket member in a position effective to latch the two portions of the enclosure together.

FIG. 3, sectioned along line 3—3 of FIG. 1, shows the ends of the elongate bracket member 14*a* flush with the enclosure surfaces. The bottom aperture 16*b* is located within the frontal corner of the enclosure bottom 20, and extending into the front and lower surfaces thereof. Top aperture 16*a* is located within the front corner of the enclosure top portion 18, and extends into the front and upper surfaces thereof.

The bracket member 14*a* can be envisioned as a plunger longitudinally movable through aperture 16*a* to perform the latch and support functions. The bracket member 14*a* includes a recessed area for accepting that part of the enclosure front surface between the top and bottom apertures 16*a* and 16*b*. The boundaries of the recess define shoulders 30,32 for cooperating with the respective front edge of aperture 16*a* and the front edge of aperture 16*b* to latch the enclosure portions together.

The bracket member 14*a* is maintained in the latched position by the retainer 26 at the top, and the biasing spring 28 at the bottom. In practice the enclosure top portion 18 contains test equipment comprising, for instance, electrical circuitry, meters, switches or the like. The bottom portion includes the biasing spring 28 configured to hold test leads for connecting such test equipment to circuitry on which tests are to be performed.

Figure 4:
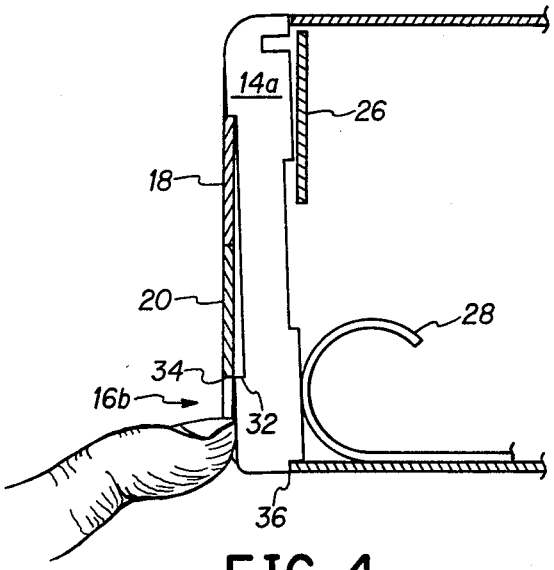
FIG. 4 is a partial sectional view, also taken along line 3—3 of FIG. 1, of the enclosure and of the latch and support system illustrating the manner in which the bracket member is laterally moved to release the latch.

Turning now to FIG. 4, there is shown the manner in which the bracket member is laterally depressed to unlatch the enclosure portions. Force is applied to the bracket member, through aperture 16*b*, in a direction opposing the tension of the biasing spring 28, so that the bracket shoulder 32 clears edge 34. The distance in which the bracket member may be manually urged is limited by the enclosure aperture edge 36 abutting the bracket member. In the depressed position, the bracket member may be pushed upwardly thereby allowing the enclosure bottom portion 20 to be opened from the top portion 18.

Figure 5:
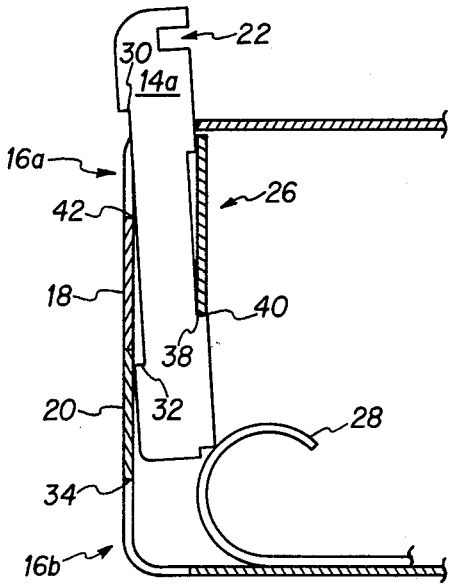
FIG. 5 is a partial sectional view of the enclosure, taken along line 3—3 of FIG. 1, illustrating the manner in which the retainer maintains the bracket member movably mounted in the top portion of the enclosure.

The distance by which the bracket may be pushed upwardly is limited by the apparatus shown in FIG. 5. As noted previously the retainer 26, in conjunction with the frontal surface of the enclosure top 18, holds the bracket member 14*a* so that it does not fall out of the enclosure. In particular, the bracket member is prevented from moving upwardly out of the enclosure aperture 16*a* by way of the bracket member shoulder 38 abutting the retainer bottom edge 40. Conversely, the bracket member is prevented from moving downwardly too far by shoulder 30 abutting edge 42 of the enclosure aperture 16*a*.

In keeping with the invention, it should be observed from FIG. 5 that a simple downward movement of the bracket member, from the extended unlatched position, is effective to latch the enclosure portions together. This aspect can be visualized by noting that the biasing spring 28 aids in guiding the bracket member 14*a* to a position whereby edge 34 and shoulder 32 snap into place thereby latching the enclosure portions together. In summary, the enclosure is closed and latched by first fully extending the bracket member(s), closing the enclosure portions, then sliding the bracket member(s) to the internal position until the snap indicates a successful latch.

Figure 6:
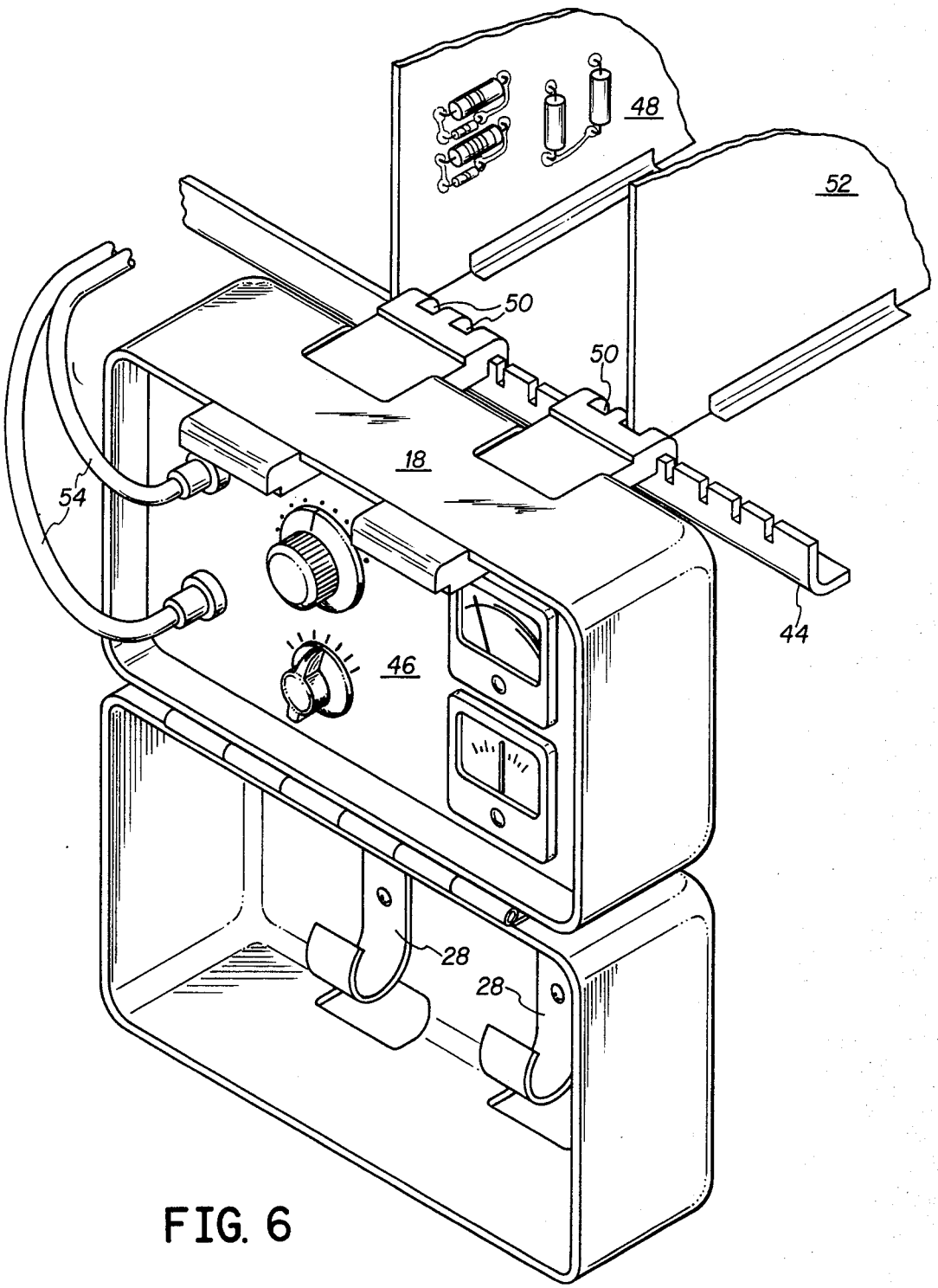
FIG. 6 is an isometric view of an open enclosure as it is supported from a card cage rack by the bracket member.

Before moving to FIG. 6, it should be noted that FIG. 5 clearly shows the groove 22 for use in attaching the bracket, and thus the enclosure, to a card cage rack. Directing attention now to FIG. 6, the enclosure, its pair of latch and support systems, is shown as it would be attached to a rail 44 of a card cage rack while utilizing the enclosure test equipment 46 to conduct tests on a circuit card 48 located within the rack. One of the principal features of the combined latch and support system is that it is capable of supporting the open enclosure from the rack. To that end, the groove 22 in each bracket member end, as heretofore mentioned, engages the vertical flange of rail 44 so that the bracket members can be horizontally fixed thereto. The enclosure top portion 18, being attached to the pair of brackets, is thereby supported from the rail.

Another aspect of the enclosure is that it may be supported anywhere along the longtudinal length of the rail 44. In many applications it is required that the test cables 54 be short and that the circuit to be tested be located proximate the test equipment. This is especially true where long test leads would introduce additional resistance or capacitance into the circuits thereby resulting in erroneous test results. Keeping that in mind it should be noted that a set of notches 50, transverse to the previously mentioned groove 22, are also formed in the bracket member end so as to accept the width of a printed circuit card. The notches 50 are spaced apart a distance so as to accommodate the highest circuit card density expected. Were it not for these notches 52, the placement of the enclosure bracket members on the rail 44 at a position occupied by a printed circuit card, such as for instance printed circuit card 52, would be very difficult.

While the pair of bracket members according to the preferred embodiment of the present invention are configured to engage with the vertical flange of the rail 44, other groove configurations may be devised to engage other rail shapes.

In summary, the disclosed combined latch and support system is contained within the enclosure when in the latched condition, and when in the unlatched condition the bracket member extends through an aperture in the enclosure so that it may be attached to an card cage rack to thereby suspend the enclosure therefrom.

Shown and described above are the fundamental novel features of the invention as applied to the preferred embodiment. It will be understood that various omissions, substitutions and changes in form and detail of the invention as described herein may be made by those skilled in the art without departing from the true spirit and scope of the invention as defined by the appended claims. Therefore, it is the intention of the invention be limited only by the scope of the following claims.

What I claim is:

1. In a portable enclosure for holding equipment on a fixed structure, a combination latch and support system comprising:

a bracket member retained in the enclosure and movable through an aperture in the enclosure to an extended position and movable back through said aperture to a retracted position, said bracket member including means for attaching to said fixed structure, said means being in a non-attaching arrangement when said bracket member is in said retracted position, and said means becoming arranged for said attaching by said bracket member moving to said extended position; and means for latching the enclosure closed when the bracket member is in said retracted position and unlatching the enclosure when in the extended position.

2. The portable enclosure as set forth in claim 1 wherein the enclosure has a bottom portion engaged by one end of said bracket member when the latter is in said retracted position, said bottom being disengaged and released from said one end of said bracket member when the latter is in said extended position, and wherein the other end of said bracket member in said extended position protrudes beyond the other periphera of the enclosure and engagingly hangs on the fixed structure to support the enclosure therefrom.

3. A latch assembly for use with an enclosure, comprising:

an enclosure top and bottom portion, each including an aperture;

an elongate bracket member movable through one of said apertures and movably mounted to the enclosure for movement from an extended position to a position internal to said enclosure;

means for latching said bracket member to each said enclosure portion when said bracket member is moved internal to said enclosure, said means for latching comprising a pair of shoulders disposed on said bracket member in such a manner that each said shoulder engages the peripheral edge of the aperture in a different one of the enclosure portions; and means for releasing said latching means, including one of said apertures configured to render the bracket member accessible when the member is internal to the enclosure, with the bracket member positioned whereby force may be applied thereto to effect a transverse movement thereof releasing the latching means.

4. A latch assembly comprising:

an enclosure having top and bottom portions and including an aperture;

an elongate bracket member movable through said aperture and mounted to the enclosure for movement from an extended position to a position internal to said enclosure, including means for attaching said bracket member to a fixed structure, said means being in a non-attaching arrangement when said bracket member is in said internal position, and said means becoming arranged for said attaching by said bracket member moving to said extended position;

means for latching said bracket member to each said enclosure portion when said bracket member is moved to said internal position;

means for releasing said latching means, including means for moving the bracket member transversely, when the member is in said internal position, so as to release the latching means and permit longitudinal movement of the bracket member to said extended position, with said accompanying arranging for attaching to a fixed structure.

5. A latch assembly for use with an enclosure comprising:

an enclosure bottom portion having an aperture within a frontal corner thereof, said aperture extending into the front and lower surfaces thereof;

an enclosure top portion, openable from said body portion, with an aperture located in the frontal corner thereof and extending into the front and upper surfaces thereof;

an elongate plunger movable into both said apertures, said plunger having a recess for accepting that part of top and bottom front surfaces between said apertures, the ends of said recess defining shoulders for abutting the edges of each said aperture so that when said enclosure surfaces between said apertures is within said recess said shoulders prevent separation of the enclosure top and bottom portions;

biasing means for laterally biasing said plunger recess against the enclosure surface so that said shoulders are maintained in an abuttable relationship with the edges of said apertures.

6. The latch assembly as set forth in claim 5 further comprising a retainer, secured internally to one enclosure portion, for slideably mounting the plunger therein so that said plunger is movable into both said apertures;

and wherein said biasing means is secured to the other enclosure portion whereby lateral manual force applied to the plunger in a direction opposing the tension of said biasing means is effective to release said abuttable relationship and allow the enclosure portions to be separated.

7. The latch assembly as set forth in claim 5 wherein, in the enclosure closed portion, the portions of the plunger exposed in both said openings are flush with the enclosure external surfaces.

8. The latch assembly as set forth in a claim 5 or 7 wherein, for use in combination with a rail of a card cage rack or the like, said plunger includes means, operable when said plunger is extended from the top portion aperture, for engaging said rail so that said enclosure can be suspended therefrom.

9. The latch assembly as set forth in claim 8 wherein said means for engaging is comprised of a groove in said plunger for engaging a vertical flange of a card cage rack rail.

10. The latch assembly as set forth in claim 9 wherein said plunger further includes a notch for accepting the width of a printed circuit card or the like so that said plunger can be attached to said rail at a position occupied by a printed circuit card.

11. The latch assembly as set forth in claim 5 wherein said biasing means is a resilient C-shaped leaf spring configured for holding equipment test leads of the like.

* * * * *